US006736497B2

(12) United States Patent
Jung

(10) Patent No.: US 6,736,497 B2
(45) Date of Patent: May 18, 2004

(54) INK CARTRIDGE AND AN INK-JET PRINTER HAVING THE SAME

(75) Inventor: Myung-song Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/305,120

(22) Filed: Nov. 27, 2002

(65) Prior Publication Data

US 2003/0117467 A1 Jun. 26, 2003

(30) Foreign Application Priority Data

Dec. 20, 2001 (KR) ..... 2001-81770

(51) Int. Cl.[7] ..... B41J 2/175; B41J 2/195
(52) U.S. Cl. ..... 347/86; 347/7
(58) Field of Search ..... 347/7, 19, 85, 347/86, 87; 101/364; 141/48

(56) References Cited

U.S. PATENT DOCUMENTS 4,202,267 A * 5/1980 Heinzl et al. ..... 101/364
4,447,820 A * 5/1984 Terasawa ..... 347/86
4,719,475 A * 1/1988 Kiyohara et al. ..... 347/86
4,935,751 A * 6/1990 Hamlin ..... 347/86
5,359,353 A 10/1994 Hunt et al.
5,732,751 A * 3/1998 Schmidt et al. ..... 141/48
5,754,207 A * 5/1998 Gragg et al. ..... 347/86
5,852,458 A * 12/1998 Scheffelin et al. ..... 347/86
6,322,207 B1 * 11/2001 Hall et al. ..... 347/85

* cited by examiner

*Primary Examiner*—Anh T. N. Vo
(74) *Attorney, Agent, or Firm*—Staas & Halsey LLP

(57) ABSTRACT

An ink-jet printer includes an ink cartridge and a carriage. The ink cartridge includes an ink reservoir storing ink, a housing to cover the ink reservoir, a panel-shaped spring disposed between the ink reservoir and the housing, and a strip connected to the panel-shaped spring having sides exposed to an outside of the housing movable when the panel-shaped spring is deformed. Indicator patterns are formed at ends of the sides of the strip to indicate an amount of ink remaining. The ink cartridge also includes strip covers to detect the amount of ink remaining in the ink reservoir; and a carriage on which the ink cartridge is mounted. The carriage includes a detecting unit optically detecting a movement of the strip through an indicator window formed on the strip cover.

23 Claims, 7 Drawing Sheets

INK CARTRIDGE AND AN INK-JET PRINTER HAVING THE SAME

CROSS-REFERENCE TO RELATED APPLICATIONS

This application claims the benefit of Korean Application No. 2001-81770 filed Dec. 20, 2001, in the Korean Intellectual Property Office, the disclosure of which is incorporated herein by reference.

BACKGROUND OF THE INVENTION

1. Field of the Invention

The present invention relates to an ink cartridge and an ink-jet printer having the same, and more particularly, to an ink cartridge detecting an amount of ink remaining in the ink cartridge, and an ink-jet printer having the same.

2. Description of the Related Art

In general, ink cartridges for ink-jet printers store ink, eject ink droplets through printheads and print images having predetermined colors onto paper. FIG. 1 illustrates an ink cartridge disclosed in U.S. Pat. No. 5,359,353 to Hunt et al. that detects an amount of ink remaining in a printing step. Referring to FIG. 1, a housing forming the outer wall of the ink cartridge includes a peripheral wall 10 and a pair of side plates (not shown), which are affixed to the peripheral wall 10 to enclose both sides of the peripheral wall 10. A flexible ink bag, which forms an enclosed space and stores ink, is disposed in the housing. Here, a pair of sides 11*a* and 11*b* formed of a flexible plastic material, are secured by cement or thermoplastic fusion onto inner edges 17*a* of the peripheral wall 10, thereby forming the flexible ink bag. Intervening metal panels 18 and 19 bear against inside surfaces of the sides 11*a* and 11*b* and are held in place by outward pressure from a double-bowed compression spring 20. Flexible strips 13 and 14 having an ink volume indicia thereon are attached at one end to the sides 11*a* and 11*b* of the flexible ink bag. The other ends of the flexible strips 13 and 14 are folded over an edge of the peripheral wall 10 and are overlapped on a space 15 formed on the peripheral wall 10. The overlapped flexible strips 13 and 14 are covered with a cover tape 24 in which a stationary window 25 is formed. Reference numeral 12 denotes a plurality of nozzles through which ink is ejected from the flexible ink bag.

In the above structure, as ink supply decreases, the sides 11*a* and 11*b* of the flexible ink bag retreat inward due to a negative pressure that increases in the flexible ink bag, causing a deformation of the flexible strips 13 and 14 connected to the sides 11*a* and 11*b* of the flexible ink bag. Thus, the ink volume indicia on the flexible strips 13 and 14 is exposed such that the amount of ink remaining is recognized through a stationary window 16 formed in the flexible strip 13 and through the stationary window 25 formed in the cover tape 24.

However, the above ink cartridge has an asymmetric structure caused by the space 15 formed at one side of the peripheral wall 10, disturbing a movement of a spring in the flexible ink bag. In addition, the amount of ink remaining cannot be recognized at all times.

SUMMARY OF THE INVENTION

Various objects and advantages of the invention will be set forth in part in the description that follows and, in part, will be obvious from the description, or may be learned by practice of the invention.

In accordance with an aspect of the present invention, there is provided an ink cartridge having an improved structure such that a user can recognize an amount of ink remaining as ink supply decreases, can simultaneously sense the amount of ink remaining using an optical sensor, and enables the user to know whether or not the ink cartridge needs to be replaced, and an ink-jet printer having the same.

In accordance with an aspect of the present invention, there is provided an ink cartridge. The ink cartridge includes an ink reservoir storing ink includes a base plate, a cover plate movable toward the base plate, and at least one flexible bag between the base plate and the cover plate; a housing having an opening that is combined with the base plate and covers the ink reservoir, and having a slit formed on a side of the housing; a panel-shaped spring disposed between the housing and the cover plate and including a housing fixing portion fixed to the housing and a plate fixing portion fixed to the cover plate; a strip having one portion that is combined with the panel-shaped spring to move when the panel-shaped spring is deformed, and another portion that is exposed to an outside of the housing through the slit of the housing, and an indicator pattern formed on a surface of the exposed portion of the strip; and a strip cover covering the exposed portion of the strip, and in which an indicator window is formed such that a user observes the indicator pattern as the strip moves.

A space having a predetermined shape, in which the exposed portion of the strip is disposed, is formed at the side of the housing in which the slit is formed. When the slit is formed at two opposite sides of the housing, both ends of the strip are exposed to the outside of the housing through the slit, and a middle part of the strip is combined with the panel-shaped spring, or one end of each of two strips is exposed to the outside of the housing through the slit, and the other end of each of the two strips is combined with the panel-shaped spring.

In accordance with an aspect of the present invention, there is provided an ink-jet printer including an ink cartridge and a carriage on which the ink cartridge is mounted. The ink cartridge includes an ink reservoir storing ink, the ink cartridge including a base plate, a cover plate movable toward the base plate, and at least one flexible bag between the base plate and the cover plate; a housing having an opening that is combined with the base plate and covers the ink reservoir, and having a slit formed on a side of the housing; a panel-shaped spring disposed between the housing and the cover plate and including a housing fixing portion fixed to the housing and a plate fixing portion fixed to the cover plate; a strip having one part that is combined with the panel-shaped spring to move when the panel-shaped spring is deformed, and another portion that is exposed to an outside of the housing through the slit of the housing, and an indicator pattern formed on a surface of the exposed portion of the strip; and a strip cover covering the exposed portion of the strip, and in which an indicator window is formed allowing a user to observe the indicator pattern as the strip moves.

The carriage includes a detecting unit which optically detects a movement of the strip through the indicator window formed on the strip cover.

Here, the detecting unit includes a light emitting portion and a light receiving portion to sense a variation in a quantity of light reflected from the strip.

In accordance with an aspect of the present invention, there is provided an ink cartridge, including: an ink reservoir storing ink; a housing covering the ink reservoir; a panel-shaped spring disposed between the ink reservoir and the housing; a strip connected to the panel-shaped spring having sides exposed to an outside of the housing movable when the panel-shaped spring is deformed; indicator patterns formed at ends of the sides of the strip to indicate an amount of ink remaining; and strip covers attached to both sides of the housing to detect the amount of ink remaining in the ink reservoir.

In accordance with an aspect of the present invention, there is provided an ink-jet printer, including: an ink cartridge including an ink reservoir storing ink, a housing to cover the ink reservoir, a panel-shaped spring disposed between the ink reservoir and the housing, a strip connected to the panel-shaped spring having sides exposed to an outside of the housing movable when the panel-shaped spring is deformed, indicator patterns formed at ends of the sides of the strip to indicate an amount of ink remaining, and strip covers to detect the amount of ink remaining in the ink reservoir; and a carriage on which the ink cartridge is mounted, the carriage includes a detecting unit optically detecting a movement of the strip through an indicator window formed on the strip cover.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

The above aspects and advantages of the present invention will become more apparent by describing in detail a preferred embodiment thereof with reference to the attached drawings in which.

DETAILED DESCRIPTION OF THE PREFERRED EMBODIMENTS

Hereinafter, embodiments of the present invention will be described in detail with reference to the attached drawings. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 1:
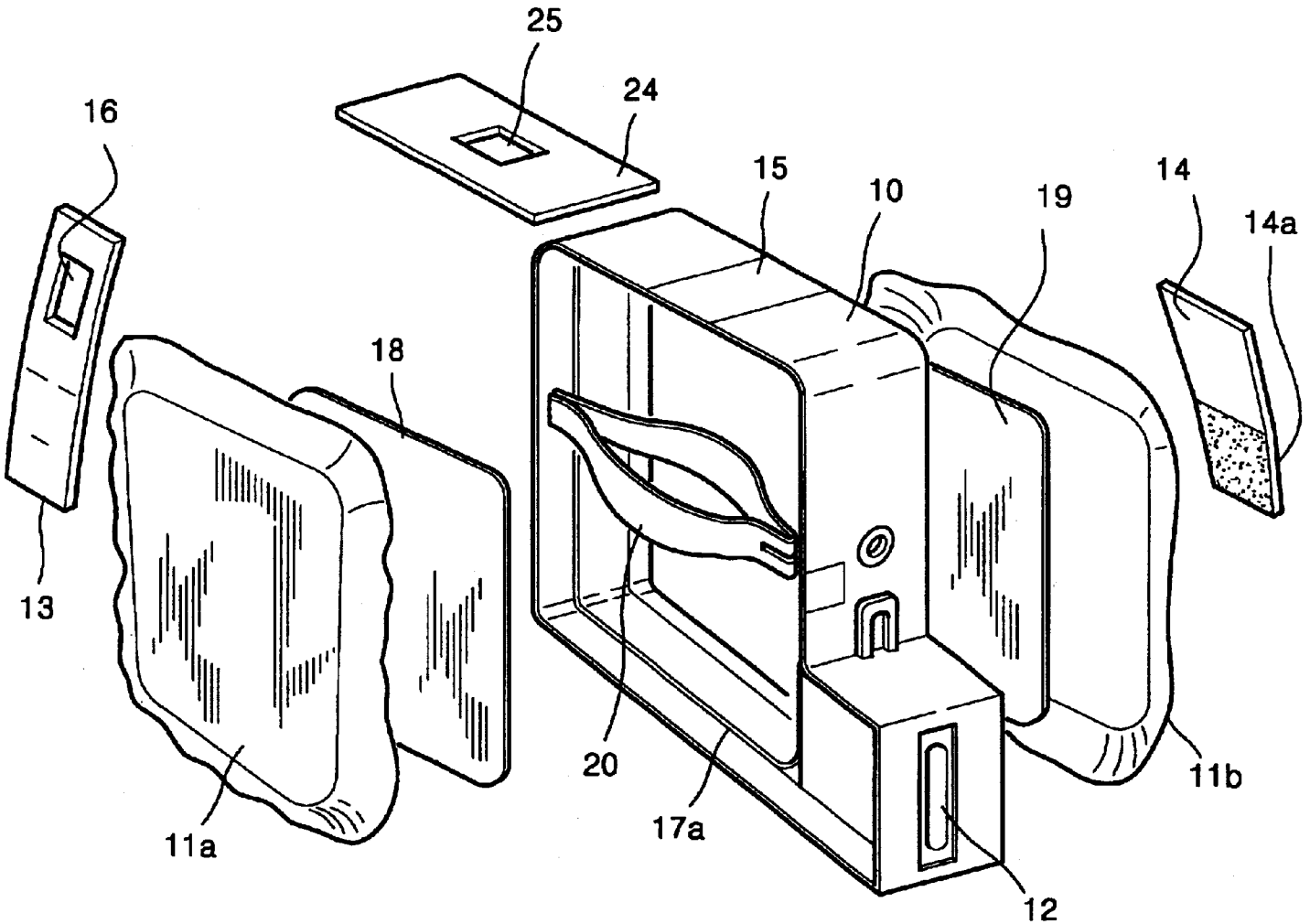
FIG. 1 (PRIOR ART)
FIG. 1 is an exploded perspective view of a conventional ink cartridge of an ink-jet printer.
Figure 2:
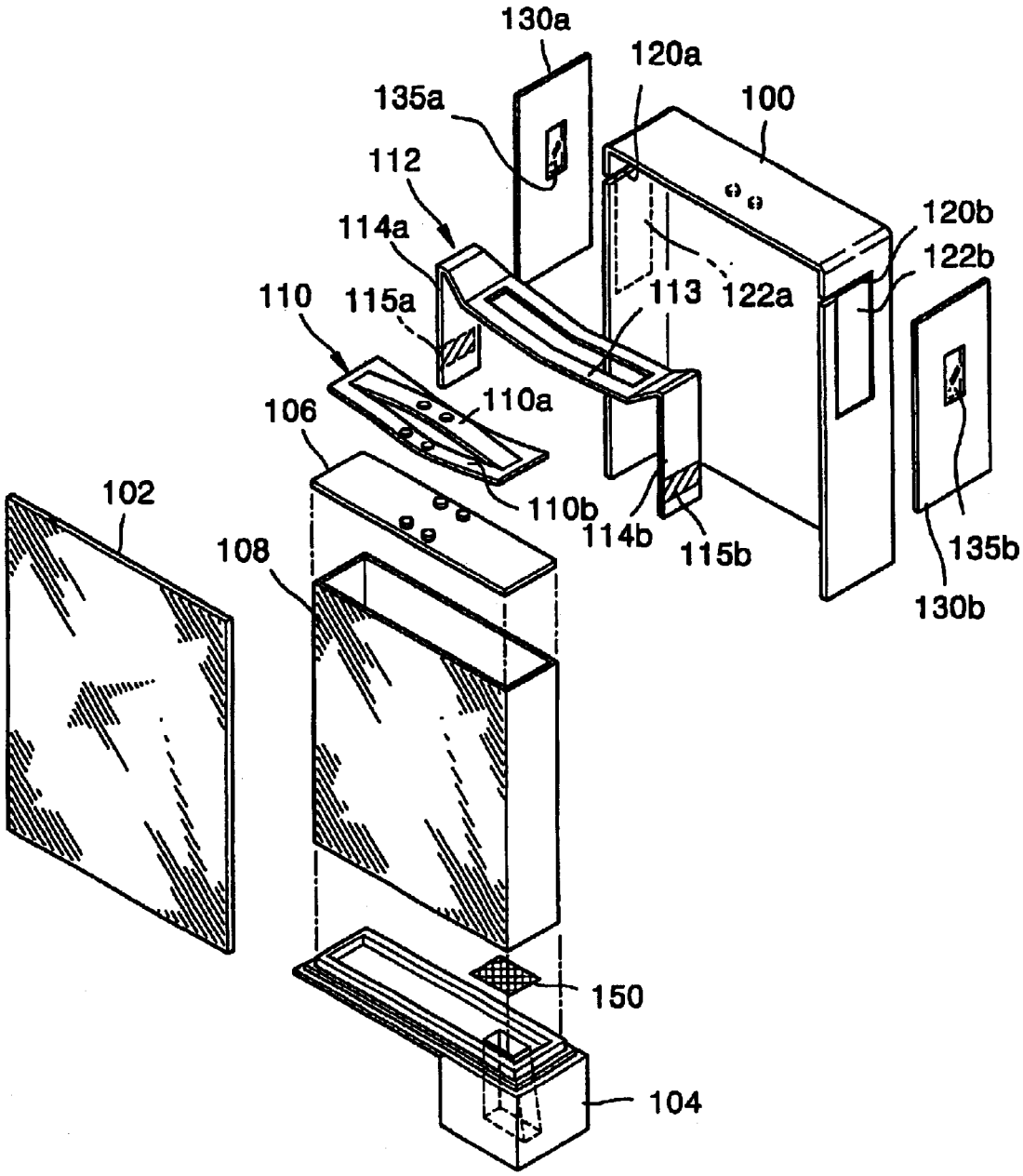
FIG. 2 is an exploded perspective view of an ink cartridge, according to an aspect of the present invention.

FIG. 2 is an exploded perspective view of an ink cartridge according to an aspect of the present invention. Referring to FIG. 2, the ink cartridge includes an ink reservoir in which ink is stored, a housing to cover the ink reservoir, a panel-shaped spring 110 disposed between the ink reservoir and the housing, and a strip 112 and strip covers 130*a* and 130*b* to detect an amount of ink remaining in the ink reservoir.

The ink reservoir includes a base plate 104, a cover plate 106, and a flexible bag 108. The cover plate 106 is parallel to the base plate 104 and able to move toward the base plate 104, and both openings of the flexible bag 108 are connected to the base plate 104 and the cover plate 106, respectively, such that a space between the base plate 104 and the cover plate 106 is closed. Here, the flexible bag 108 is formed of a deformable material such that the flexible bag 108 retreats inward, and the cover plate 106 moves downward as the ink supply in the ink reservoir decreases. In alternative embodiments of the present invention, more than one flexible bag 108 may be provided.

The housing includes a housing body 100 and a housing cover 102, and an opening in a lower portion of the housing is combined with the base plate 104 so as to cover the ink reservoir. Slits 120*a* and 120*b* are formed on both sides opposite to the housing body 100, and spaces 122*a* and 122*b* having predetermined shapes are formed under the slits 120*a* and 120*b*.

The panel-shaped spring 110 is installed between the housing and the cover plate 106 so that the ink reservoir is maintained at a proper negative pressure due to an elastic restoring force applied to pull the cover plate 106. Here, the panel-shaped spring 110 includes a housing fixing portion 110*a* and a plate fixing portion 110*b* such that the housing fixing portion 110*a* and the plate fixing portion 110*b* are fixed to the housing body 100 and the cover plate 106, respectively. The panel-shaped spring 110 may be provided in various shapes, and a plurality of panel-shaped springs may be installed.

A middle part 113 of the strip 112 is combined with the panel-shaped spring 110 to be movable depending on the deformation of the panel-shaped spring 110, and both sides 114*a* and 114*b* of the strip 112 are exposed to the outside of the housing through the slits 120*a* and 120*b* formed on both sides of the housing body 100. Both sides 114*a* and 114*b* of the strip 112 exposed to the outside of the housing are disposed in the spaces 122*a* and 122*b* formed on both sides of the housing body 100, such as to move in an upward direction or a downward direction, and rectangular indicator patterns 115*a* and 115*b* to indicate the amount of ink remaining are formed at ends of the sides 114*a* and 114*b*. Hence, the indicator patterns 115*a* and 115*b* have reflection factors different from those of portions of the sides 114*a* and 114*b* where the indicator patterns 115*a* and 115*b* are not formed.

The strip covers 130*a* and 130*b* attach to both sides of the housing and cover the sides 114*a* and 114*b* of the strip 112 exposed to the outside of the housing. Indicator windows 135*a* and 135*b* are formed on the strip covers 130*a* and 130*b* to observe the indicator patterns 115*a* and 115*b* as the both sides 114*a* and 114*b* of the strip 112 exposed to the outside of the housing move in the upward or downward directions.

In the drawing, reference numeral 150 denotes a filter to filter ink in the ink reservoir and to transfer the filtered ink to a printhead (not shown).

Steps performed in the ink cartridge having the above structure as the ink supply in the ink reservoir decreases will be described below.

Figure 3:
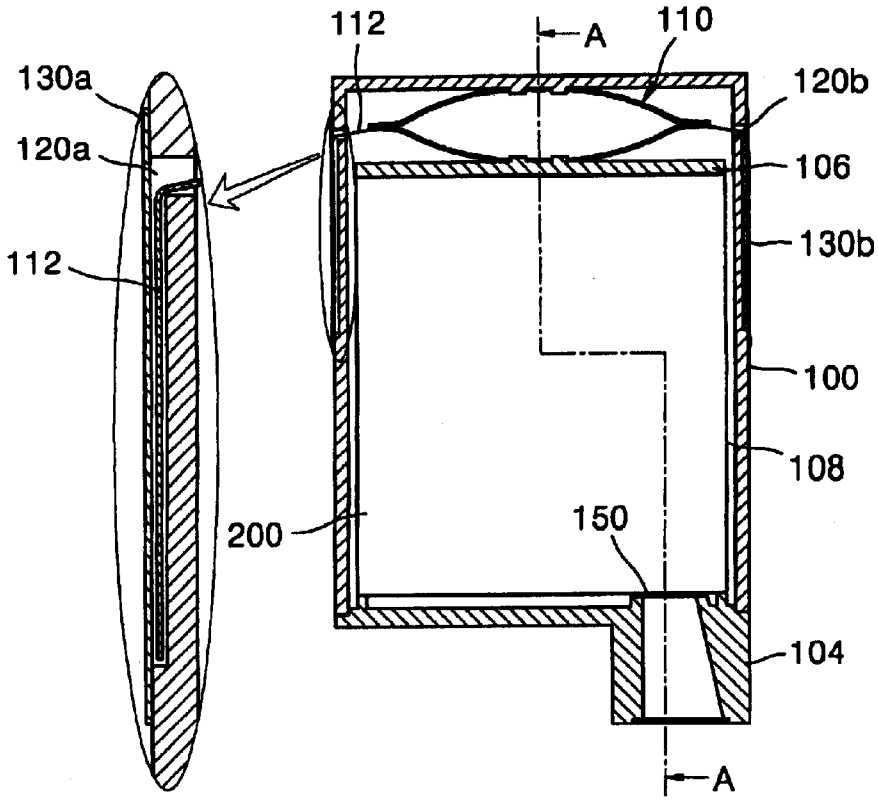
FIG. 3 illustrates a state where ink in the ink cartridge, according to an aspect the present invention, is full.
Figure 4:
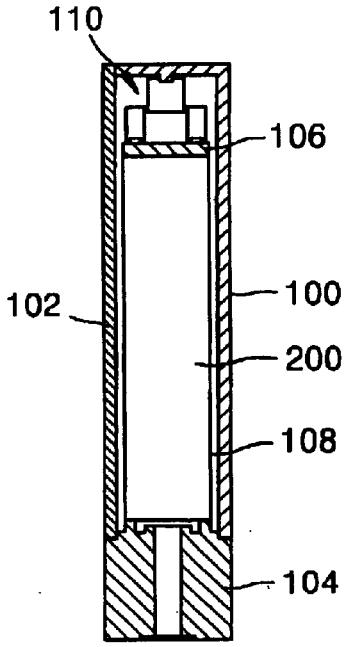
FIG. 4 is a cross-sectional view taken along a line A—A of FIG. 3.
Figure 5:
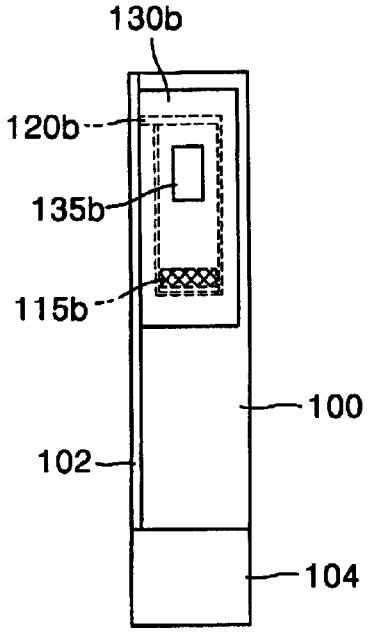
FIG. 5 is a right-side view of FIG. 3.

FIGS. 3 through 5 illustrate a state where the ink in the ink cartridge according to an aspect of the present invention is full, and FIG. 4 is a cross-sectional view taken along a line A—A of FIG. 3, and FIG. 5 is a right-side view of FIG. 3.

Referring to FIGS. 3 through 5, at a beginning of using the ink cartridge, ink is filled in the ink reservoir 200 which includes the base plate 104, the cover plate 106, and the flexible bag 108. The panel-shaped spring 110 fixed to the cover plate 106 and to the housing body 100 pulls the cover plate 106, causing a negative pressure in the ink reservoir 200. Here, as shown in FIG. 3, the middle part 113 of the strip 112 is fixed to the panel-shaped spring 110 by an adhesive. Both sides 114*a* and 114*b* of the strip 112 are exposed to the outside of the housing through the slits 120*a* and 120*b* formed on both sides of the housing body 100, and the sides 114*a* and 114*b* of the exposed strip 112 are disposed in the spaces 122*a* and 122*b* formed at the sides of the housing body 100. Here, the rectangular indicator patterns 115*a* and 115*b* to indicate an amount of ink remaining, are formed at both ends of the strip 112. Both sides 114*a* and 114*b* of the strip 112 are covered by the strip covers 130*a* and 130*b*, and the indicator windows 135*a* and 135*b* are formed on the strip covers 130*a* and 130*b* to observe the indicator patterns 115*a* and 115*b*.

In the initial state of using the ink cartridge, as shown in FIG. 5, the indicator patterns 115*a* and 115*b* are disposed at the bottom of the spaces 122*a* and 122*b*, and thus the indicator patterns 115*a* and 115*b* are not exposed through the indicator windows 135*a* and 135*b* formed in the strip covers 130*a* and 130*b*.

Figure 6:
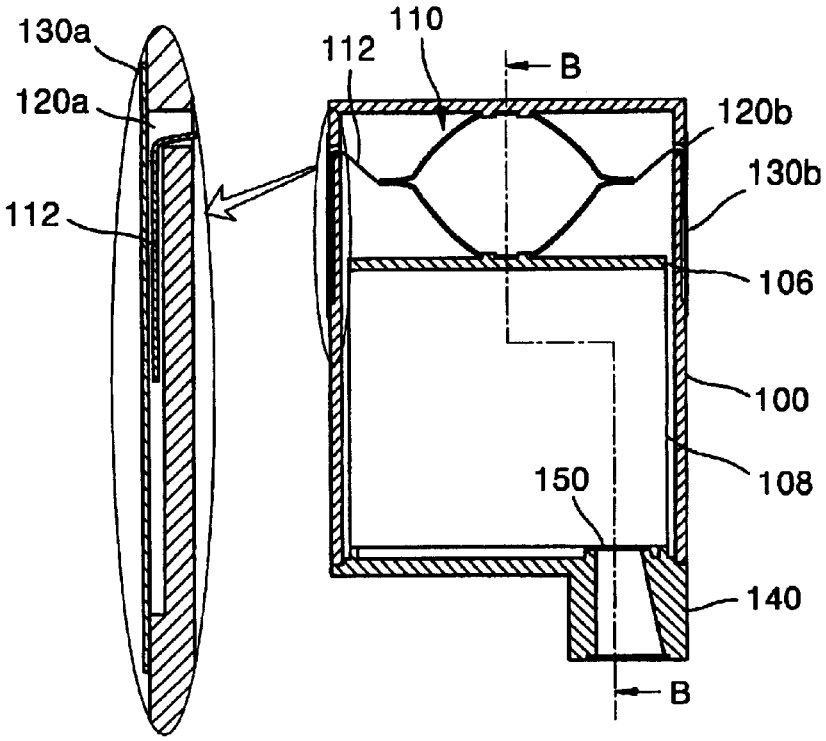
FIG. 6 illustrates a state where the ink in the ink cartridge, according to an aspect of the present invention, is depleted.
Figure 7:
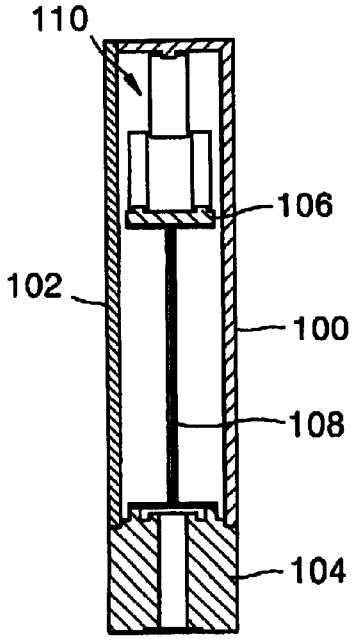
FIG. 7 is a cross-sectional view taken along a line B—B of FIG. 6.
Figure 8:
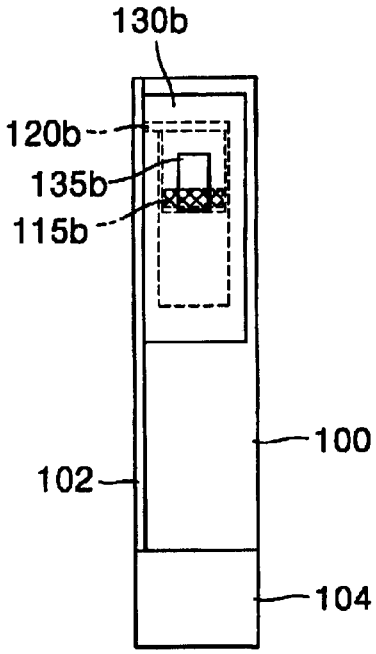
FIG. 8 is a right-side view of FIG. 6.

FIGS. 6 through 8 illustrate a state where the ink in the ink cartridge, according to an aspect of the present invention, is depleted, and FIG. 7 is a cross-sectional view taken along a line B—B of FIG. 6, and FIG. 8 is a right-side view of FIG. 6.

Referring to FIGS. 6 through 8, when the ink supply in the ink reservoir 200 decreases, the flexible bag 108 retreats inward such that the cover plate 106 attached to the flexible bag 108 goes down. Thus, the panel-shaped spring 110 fixed to the cover plate 106 and the housing body 100 is deformed downward. When the middle part 113 of the strip 112 fixed to the panel-shaped spring 110 goes down as the panel-shaped spring 110 is deformed, both sides 114*a* and 114*b* of the strip 112 exposed to the outside of the housing go up while being supported by the slits 120*a* and 120*b* formed at the sides of the housing body 100. In this way, as the ink supply decreases, a movement amount of the strip 114 increases. Consequently, when a predetermined amount of ink remains in the ink reservoir 200, as shown in FIG. 8, the indicator patterns 115*a* and 115*b* formed at ends of the strip 114 are exposed through the indicator windows 135*a* and 135*b*. Thus, a user can recognize the amount of ink remaining stored in the ink reservoir 200.

Figure 9:
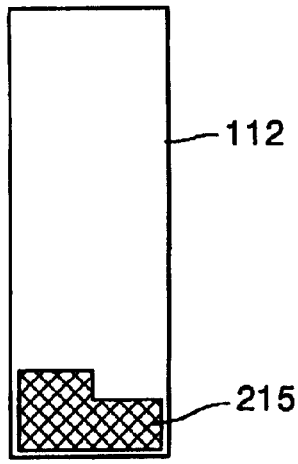
FIG. 9 illustrates a strip in which an indicator pattern used in the ink cartridge, according to an aspect of the present invention, is formed.

The indicator patterns may be formed in various shapes other than the above-mentioned rectangular indicator patterns 115*a* and 115*b*. In FIG. 9, a step-shaped indicator pattern 215 is formed on the strip 112 such that the amount of ink remaining and an amount of ink exhaustion can be indicated depending on a distance the strip 112 has moved.

In the drawings and the above-description, a middle part of one strip is combined with the panel-shaped spring, and both sides of the strip are exposed to the outside of the housing. However, in an alternative embodiment, one side of each of two separate strips may be combined with the panel-shaped spring, and the other side of each of the two strips may be exposed to the outside of the housing through slits formed on both sides opposite of the housing body 100. In this case, indicator patterns are formed at each end of the exposed strips.

Alternatively, a slit may be formed at only one side of the housing body 100, and one end of one strip may be combined with the panel-shaped spring while another end may be exposed to the outside of the housing through the slit.

Figure 10:
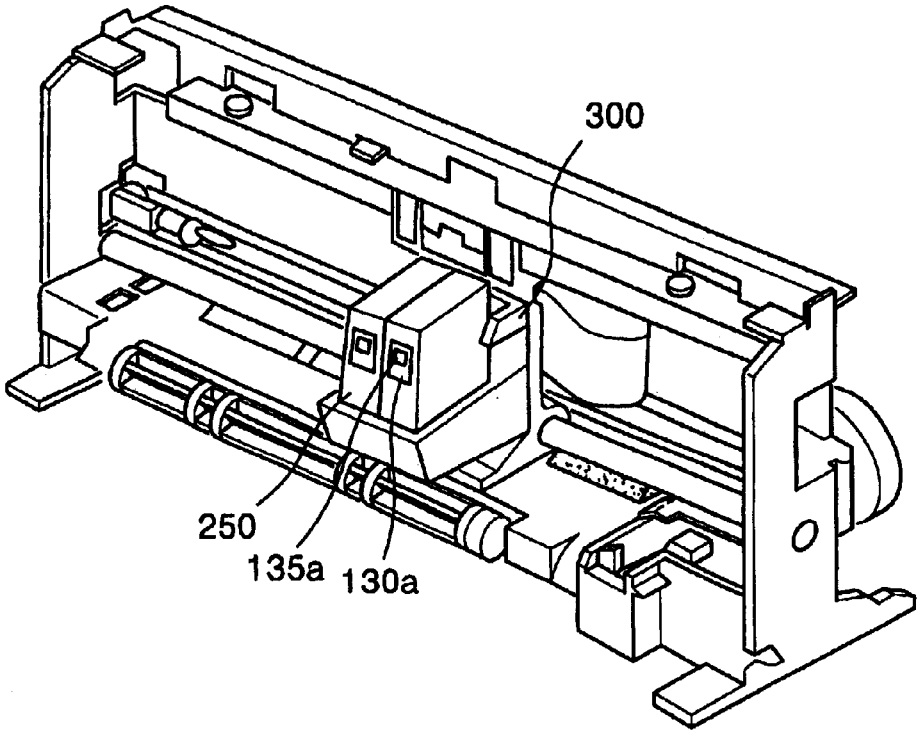
FIG. 10 is an internal perspective view of an ink-jet printer having the ink cartridge according to an aspect of the present invention.

FIG. 10 is an internal perspective view of an ink-jet printer having the ink cartridge according to an aspect of the present invention. Referring to FIG. 10, the ink-jet printer includes an ink cartridge 250 and a carriage 300 on which the ink cartridge 250 is mounted. The carriage 300 on which the ink cartridge 250 is mounted moves horizontally, and the ink is spread onto a surface of a paper from the ink cartridge 250, thereby performing printing.

Figure 11:
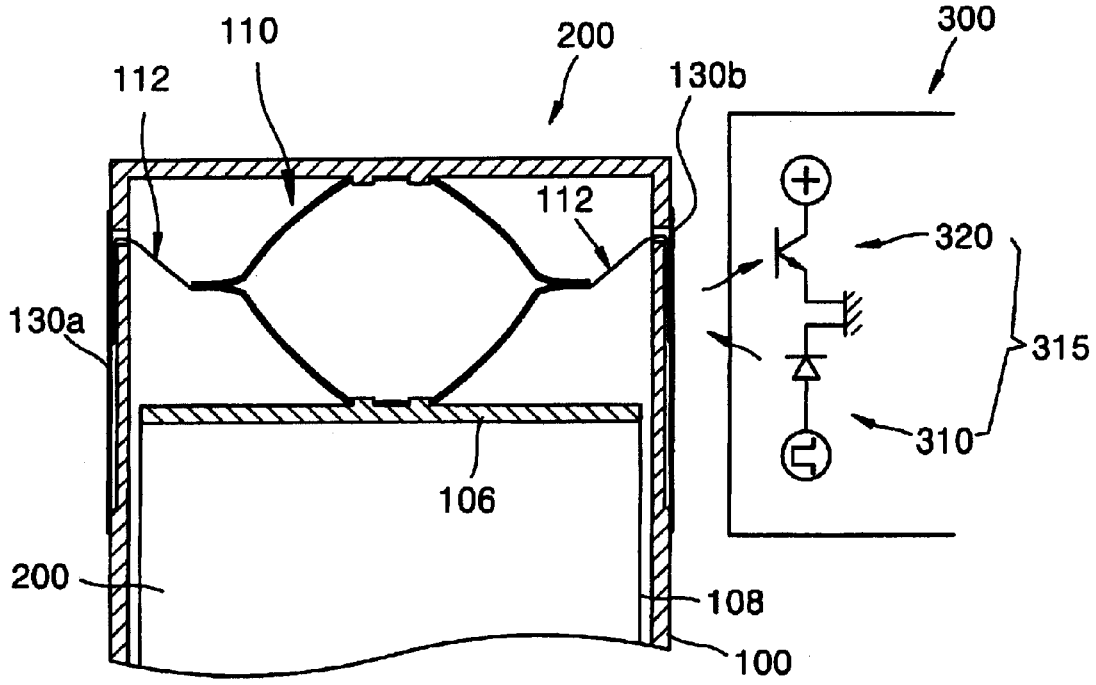
FIG. 11 illustrates a main part of the ink-jet printer according to an aspect of the present invention.

The ink cartridge 250 is the same as the ink cartridge shown in FIG. 2, and as shown in FIG. 11, the carriage 300 includes a photo couple sensor 315 including a light emitting portion 310 and a light receiving portion 320 such that the movement of the strip 112 can be detected through the indicator window 135*b* formed in the strip cover 130*b* corresponding to the photo couple sensor 315.

Figure 12:
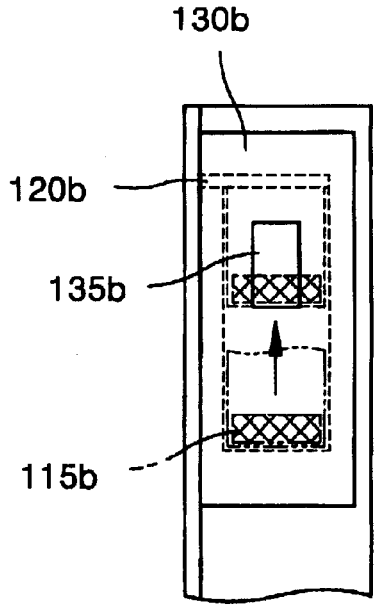
FIG. 12 illustrates the indicator pattern formed on the strip of the ink cartridge, according to an aspect of the present invention, moving as the ink is depleted.

In the above structure, as the initial state of ink cartridge 250 is changed to the final state, as shown in FIG. 12, the indicator patterns 115*a* and 115*b* formed on the strip 112 move in a direction indicated by an arrow shown in FIG. 12 and are exposed through the indicator windows 135*a* and 135*b*. In this case, the photo couple sensor 320 installed in the carriage 300 senses a variation in a signal indicating the quantity of light reflected from the indicator pattern 115*b* through the indicator window 135*b* formed in the strip cover 130*b* corresponding to the photo couple sensor 320 and transmits a signal to indicate the amount of ink remaining to a microprocessor (not shown) to control the ink-jet printer. Subsequently, the microprocessor indicates the amount of ink remaining to the user by transmitting the signal to a computer driver (not shown).

Because the indicator patterns 115*a* and 115*b* are formed at both ends 114*a* and 114*b* of the strip 112, both indicator patterns 115*a* and 115*b* move as the panel-shaped spring 110 is deformed and are exposed through the indicator windows 135*a* and 135*b*. The user observes the indicator pattern 115*a* through the indicator window 135*a* shown in FIG. 10, thereby seeing the amount of ink remaining in the ink reservoir 200.

As described above, in the ink cartridge according to an aspect of the present invention and the ink-jet printer employing the same, an amount of ink remaining in the ink cartridge is sensed by a non-contact sensor, and thus a performance of the ink cartridge and the ink-jet printer are not affected. In addition, the sensor can be disposed in the ink carriage, and thus there is no need to draw out an additional line to sense a signal. Further, a signal indicating the amount of ink remaining provided by the computer driver is identical to a signal generated when the user actually checks the amount of ink remaining so that the user can know more precisely when a new ink cartridge should be prepared, and a time required to prepare the ink cartridge can be reduced.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An ink cartridge comprising:

an ink reservoir storing ink and comprising a base plate, a cover plate movable toward the base plate, and at least one flexible bag between the base plate and the cover plate;

a housing having an opening that is combined with the base plate and covers the ink reservoir, and having a slit formed on a side of the housing;

a panel-shaped spring disposed between the housing and the cover plate and comprising a housing fixing portion fixed to the housing and a plate fixing portion fixed to the cover plate;

a strip having one portion that is combined with the panel-shaped spring to move when the panel-shaped spring is deformed, and another portion that is exposed to an outside of the housing through the slit of the housing, and an indicator pattern formed on a surface of the exposed portion of the strip; and a strip cover covering the exposed portion of the strip, and in which an indicator window is formed such that a user observes the indicator pattern as the strip moves.

2. The ink cartridge of claim 1, wherein a space having a predetermined shape, in which the exposed portion of the strip is disposed, is formed at the side of the housing in which the slit is formed.

3. The ink cartridge of claim 1, wherein the slit is formed at two opposite sides of the housing, both ends of the strip are exposed to the outside of the housing through the slit, and a middle part of the strip is combined with the panel-shaped spring.

4. The ink cartridge of claim 1, wherein the strip comprises two strips and the slit is formed at two opposite sides of the housing, one end of each of the two strips is exposed to the outside of the housing through the slit, and the other end of each of the two strips is combined with the panel-shaped spring.

5. An ink-jet printer having an ink cartridge and a carriage on which the ink cartridge is mounted, the ink cartridge comprising:

an ink reservoir storing ink and comprising a base plate, a cover plate movable toward the base plate, and at least one flexible bag between the base plate and the cover plate;

a housing having an opening that is combined with the base plate and covers the ink reservoir, and having a slit formed on a side of the housing;

a panel-shaped spring disposed between the housing and the cover plate and comprising a housing fixing portion fixed to the housing and a plate fixing portion fixed to the cover plate;

a strip having one part that is combined with the panel-shaped spring to move when the panel-shaped spring is deformed, and another portion that is exposed to an outside of the housing through the slit of the housing, and an indicator pattern formed on a surface of the exposed portion of the strip; and a strip cover covering the exposed portion of the strip, and in which an indicator window is formed allowing a user to observe the indicator pattern as the strip moves, wherein the carriage comprises a detecting unit optically detecting a movement of the strip through the indicator window formed on the strip cover.

6. The ink-jet printer of claim 5, wherein the detecting unit includes a light emitting portion and a light receiving portion to sense a variation in a quantity of light reflected from the strip.

7. An ink cartridge, comprising:

an ink reservoir storing ink;

a housing covering the ink reservoir;

a panel-shaped spring disposed between the ink reservoir and the housing;

a strip connected to the panel-shaped spring having sides exposed to an outside of the housing movable when the panel-shaped spring is deformed;

indicator patterns formed at ends of the sides of the strip to indicate an amount of ink remaining; and strip covers attached to both sides of the housing to detect the amount of ink remaining in the ink reservoir.

8. The ink cartridge of claim 7, wherein the sides of the strip are exposed to the outside of the housing through slits and are disposed in spaces formed at both sides of the housing body.

9. The ink cartridge of claim 7, wherein a middle part of the strip is combined with the panel-shaped spring to be movable in an upward direction or a downward direction depending on the deformation of the panel-shaped spring.

10. The ink cartridge of claim 7, wherein the strip covers cover the sides of the strip exposed to the outside of the housing.

11. The ink cartridge of claim 10, further comprising:

indicator windows formed on the strip covers to observe the indicator patterns as the sides of the strip exposed to the outside of the housing move in an upward direction or a downward direction.

12. The ink cartridge of claim 7, wherein the ink reservoir comprises:

a base plate, a cover plate parallel to the base plate and movable towards the base plate, and a flexible bag, wherein one end of the flexible bag is attached to the base plate and another end of the flexible bag is attached to the cover plate and the cover plate moves in a downward direction as the ink supply in the ink reservoir decreases.

13. The ink cartridge of claim 12, wherein the panel-shaped spring comprises a housing fixing portion and a plate fixing portion, wherein the housing fixing portion and the plate fixing portion are fixed to the housing body and the cover plate, respectively.

14. The ink cartridge of claim 12, wherein the panel-shaped spring is installed between the housing and the cover plate to maintain the ink reservoir at a negative pressure.

15. The ink cartridge of claim 12, wherein the housing comprises:

a housing body, and a housing cover, where an opening in a lower portion of the housing receiving the base plate to cover the ink reservoir.

16. The ink cartridge of claim 15, further comprising slits formed at both sides opposite to the housing body, and spaces having predetermined shapes formed under the slits.

17. The ink cartridge of claim 15, wherein the strip comprises two separate strips, one side of each of the two separate strips is attached to the panel-shaped spring, and another side of each of the two strips is exposed to an outside of the housing through slits formed on both sides opposite of the housing body, where the indicator patterns are formed at each end of the exposed strips.

18. The ink cartridge of claim 7, wherein the indicator patterns have reflection factors different from portions of the sides of the strip where the indicator patterns are not formed.

19. The ink cartridge of claim 7, wherein a middle part of the strip is fixed to the panel-shaped spring by an adhesive.

20. The ink cartridge of claim 7, wherein the ink reservoir comprises:

a base plate, a cover plate parallel to the base plate and movable towards the base plate, and a plurality of flexible bags, wherein one end of the flexible bags is attached to the base plate and another end of the flexible bags is attached to the cover plate and the cover plate moves in a downward direction as the ink supply in the ink reservoir decreases.

21. An ink-jet printer, comprising:

an ink cartridge comprising:

an ink reservoir storing ink, a housing to cover the ink reservoir, a panel-shaped spring disposed between the ink reservoir and the housing, a strip connected to the panel-shaped spring having sides exposed to an outside of the housing movable when the panel-shaped spring is deformed, indicator patterns formed at ends of the sides of the strip to indicate an amount of ink remaining, and strip covers to detect the amount of ink remaining in the ink reservoir; and a carriage on which the ink cartridge is mounted, the carriage comprising a detecting unit optically detecting a movement of the strip through an indicator window formed on the strip cover.

22. The ink-jet printer of claim 21, wherein the carriage further comprises a photo couple sensor having a light emitting portion and a light receiving portion to detect the movement of the strip through the indicator window formed on the strip cover.

23. The ink-jet printer of claim 22, wherein the photo couple sensor senses a variation in a signal indicating a quantity of light reflected from the indicator patterns through the indicator window and transmits a signal indicative of the amount of ink remaining to control the ink-jet printer.

* * * * *